US010546705B2

(12) United States Patent
Chatroux et al.

(10) Patent No.: US 10,546,705 B2
(45) Date of Patent: Jan. 28, 2020

(54) SWITCH FOR SHORT-CIRCUITING A DIRECT-CURRENT POWER SOURCE

(71) Applicant: COMMISSARIAT A L'ENERGIE ATOMIQUE ET AUX ENERGIES ALTERNATIVES, Paris (FR)

(72) Inventors: Daniel Chatroux, Teche (FR); Sebastien Carcouet, Vif (FR); Jeremy Dupont, Bourgoin-Jallieu (FR); Pierre Perichon, Voiron (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 150 days.

(21) Appl. No.: 15/021,194

(22) PCT Filed: Sep. 10, 2014

(86) PCT No.: PCT/EP2014/069329

§ 371 (c)(1),
(2) Date: Mar. 10, 2016

(87) PCT Pub. No.: WO2015/036455

PCT Pub. Date: Mar. 19, 2015

(65) Prior Publication Data

US 2016/0225558 A1 Aug. 4, 2016

(30) Foreign Application Priority Data

Sep. 13, 2013 (FR) ..... 13 58869

(51) Int. Cl.
*H01H 39/00* (2006.01)
*H01H 9/54* (2006.01)

(52) U.S. Cl.
CPC ..... *H01H 39/004* (2013.01); *H01H 9/54* (2013.01)

(58) Field of Classification Search
CPC ..... H01H 39/004; H01H 39/006; H01H 2039/008; H01H 9/54
(Continued)

(56) References Cited

U.S. PATENT DOCUMENTS 2,721,240 A 10/1955 Filbert, Jr.
3,248,504 A 4/1966 McGirr et al.
(Continued)

FOREIGN PATENT DOCUMENTS

FR 1 605 493 A 6/1977
FR 2 953 324 A1 6/2011
(Continued)

OTHER PUBLICATIONS

EPO machine translation of Marcaire FR 1605493.*
(Continued)

*Primary Examiner* — Jacob R Crum
(74) *Attorney, Agent, or Firm* — Oblon, McClelland, Maier & Neustadt, L.L.P.

(57) ABSTRACT

A switch including: first and second electrically conductive electrodes; an electrically conductive element; an electrically insulating medium separating the first and second electrodes and separating the electrically conductive element from the second electrode; and a pyrotechnic element including an explosive, explosion of the explosive causing the electrically conductive element to be driven into contact with the second electrode and the conductive element to be welded to the second electrode to form an electrically conductive link between the first and second electrodes.

15 Claims, 4 Drawing Sheets

(58) Field of Classification Search
USPC ..... 337/401
See application file for complete search history.

(56) References Cited

U.S. PATENT DOCUMENTS

| | | | | |
|---|---|---|---|---|
| 3,475,572 | A * | 10/1969 | Voyentzie | H01H 35/02 102/262 |
| 3,868,131 | A * | 2/1975 | Zondag | B21D 39/066 228/107 |
| 4,150,266 | A | 4/1979 | Patrichi | |
| 6,046,575 | A | 4/2000 | Demuro | |
| 6,281,782 | B1 * | 8/2001 | Morimoto | H01H 37/76 337/182 |
| 6,388,554 | B1 * | 5/2002 | Yamaguchi | H01H 39/00 337/157 |
| 2004/0112239 | A1 | 6/2004 | Parks et al. | |
| 2007/0066103 | A1 | 3/2007 | Brede et al. | |
| 2009/0141416 | A1 * | 6/2009 | Dommaschk | H01H 39/004 361/78 |
| 2011/0020689 | A1 * | 1/2011 | Nam | H01M 6/36 429/120 |
| 2013/0033796 | A1 * | 2/2013 | Shea | H01H 39/004 361/126 |
| 2013/0126326 | A1 | 5/2013 | Borg | |
| 2014/0167655 | A1 | 6/2014 | Chatroux et al. | |

FOREIGN PATENT DOCUMENTS

| | | | |
|---|---|---|---|
| JP | 2011-192531 | A | 9/2011 |
| JP | 2012-61934 | A | 3/2012 |
| WO | 2012/171917 | A1 | 12/2012 |

OTHER PUBLICATIONS

International Search Report dated Nov. 26, 2014 in PCT/EP14/69329 Filed Sep. 10, 2014.

Office Action dated Apr. 17, 2018 in Japanese Patent Application No. 2016-541927 (with English language translation) citing documents AA and AO-AP therein, 14 pages.

* cited by examiner

SWITCH FOR SHORT-CIRCUITING A DIRECT-CURRENT POWER SOURCE

The invention relates to DC voltage power sources, and in particular the electrical equipment items intended to ensure the safety of such DC voltage sources.

DC voltage power sources are commonly based on the use of electrochemical accumulators. These voltage sources can for example be used in the field of electrical and hybrid transport systems or embedded systems.

An electrochemical accumulator usually has a nominal voltage of the following order of magnitude:

1.2 V for batteries of NiMH type, 3.3 V for a lithium-ion iron phosphate $LiFePO_4$ technology, 4.2 V for a cobalt oxide based lithium-ion type technology.

These nominal voltages are too low in relation to the requirements of most of the systems to be powered. To obtain the appropriate voltage level, a number of accumulators are placed in series. To obtain high powers and capacities, a number of accumulators are placed in parallel. The number of stages (number of accumulators in series) and the number of accumulators in parallel in each stage vary as a function of the voltage, of the current and of the capacity desired for the battery. The combination of a number of accumulators is called an accumulator battery.

Such batteries are for example used in vehicles to drive an alternating current electric motor via an inverter. Such batteries also have a high capacity in order to favor the range of the vehicle in electric mode. Typically, an electric vehicle uses an accumulator battery with a nominal voltage of the order of 400V, with a peak current of 200 A and a capacity of 20 kWh.

The electrochemical accumulators used for such vehicles are generally of the lithium-ion type for their capacity to store a significant energy with a weight and a volume that are contained. The lithium-ion iron phosphate $LiFePO_4$ type battery technologies are the subject of significant developments by virtue of a high intrinsic safety level, at the cost of a slightly reduced energy storage density.

The document WO2012171917 describes battery elements comprising electrochemical accumulators, such elements being intended to be connected in series to form a DC voltage power source. Each battery element is provided with a protection device intended to isolate the battery of this element from other elements, or to ensure the continuity of service of the DC voltage source, or to allow maintenance operations on this DC voltage source. Each battery element comprises two branches in parallel connected between its two terminals. In a first branch, the battery is connected in series with a MOSFET switch of normally-open type. In a second branch, the two terminals are connected via a normally-closed switch. When the element is used, the normally-closed switch is kept open and the normally-open switch is kept closed. In the absence of control due to a malfunction or maintenance, the normally-closed switch remains closed and the normally-open switch remains open, such that the voltage of the battery is not applied to the terminals of the element.

In practice, such an element presents drawbacks. The MOSFET switches and their controls come at a relatively high cost, notably because of the need to add a heat sink to them. Furthermore, these switches are the source of spurious energy losses and overheating even when they are open. In particular, the normally-closed switch causes permanent losses upon the operation of the element (when this switch is therefore open) although the probability of the occurrence of a fault is reduced.

The document FR1605493 describes a switch for firing missiles. The switch is temporarily closed for the firing time, then destroyed, which is not an inconvenience since the missile also ends up being destroyed. Such a switch is therefore unsuitable for guaranteeing a closed state in the absence of control.

The document U.S. Pat. No. 2,721,240 describes a switch, comprising two electrodes and a conductive element propelled by a pyrotechnic charge. Upon its propulsion, the conductive element is passed through by the electrodes and forms an electrical contact between them. The reliability of such a contact is insufficient to guarantee that a closed state of the switch will be maintained.

The invention aims to resolve one or more of these drawbacks. The invention thus relates to a switch, as defined in the attached claims.

The invention further relates to a DC voltage power supply system, as defined in the attached claims.

Other features and advantages of the invention will emerge clearly from the description which is given thereof hereinbelow, in an indicative and nonlimiting manner, with reference to the attached drawings, in which.

The invention proposes a safety switch for a DC voltage power supply. Such a switch comprises first and second electrically conductive electrodes and an electrically conductive element. Initially, an electrically insulating medium separates these electrodes from one another, and also separates at least the electrically conductive element from the second electrode. The switch further comprises a pyrotechnic element including an explosive, the explosion of which causes the electrically conductive element to be driven into contact with the second electrode and the conductive element to be welded with the second electrode to form a solid and durable electrically conductive link between the first and second electrodes. "Solid and durable" should be understood to mean that the electrically conductive link remains after the explosion. The weld is therefore not destroyed by this same explosion.

In the presence of a malfunction, the connection between the two electrodes can thus be closed solidly, reliably and durably, in order to short-circuit an electrical system connected to the terminals of the switch, notably when demanded by safety considerations. Because of the energy applied by the explosion onto the electrically conductive element, the latter is welded to the second electrode, which makes it possible to ensure an electrical contact between the conductive element and the second electrode allowing current of high intensity to pass between the first and second electrodes with reduced losses. The conduction between the first and second electrodes can for example be guaranteed without break, even for short-circuit currents of a DC voltage power supply.

Such a switch therefore proves particularly advantageous, particularly for securing a DC voltage power supply, even though a person skilled in the art generally would not consider the use of pyrotechnic elements in proximity to a component considered to be dangerous (for example a DC voltage power supply based on electrochemical cells of the lithium-ion type). In practice, the risk associated with the explosion of a pyrotechnic element is well controlled, by virtue of the mass production of such components, in particular for manufacturing airbags. Thus, the quantity of energy released by an explosion and the guarantee of the explosion are parameters that are perfectly controlled in pyrotechnic elements.

Figure 1:
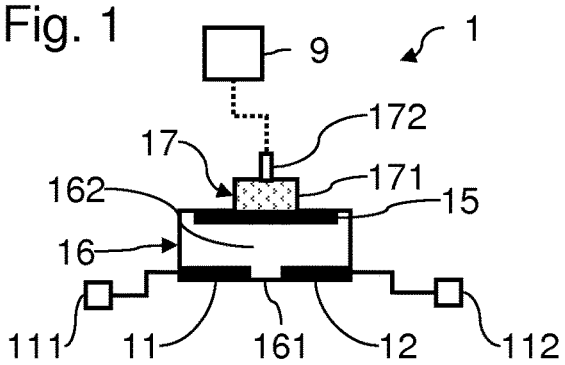
FIGS. 1 and 2 are schematic representations of a first exemplary switch according to the invention in two operating configurations.

FIG. 1 is a schematic cross-sectional view of a first exemplary switch 1 according to the invention. The switch 1 is of the normally-open type between a first electrode 11 and a second electrode 12. The electrodes 11 and 12 are electrically conductive. The electrode 11 is, for example, electrically connected to a connector 111. The electrode 12 is, for example, electrically connected to a connector 112. The connectors 111 and 112 advantageously make it possible to connect the switch 1 in a circuit or to the terminals of an electrical system.

The electrodes 11 and 12 are here housed in a chamber 16. The electrodes 11 and 12 are fixed against an internal wall 161 of the chamber 16, in order to ensure that they are mechanically secured. The switch 1 further comprises an electrically conductive element 15. The element 15 is housed inside the chamber 16. The element 15 is separated from the electrodes 11 and 12 via an electrically insulating medium 162 present in the chamber 16. The medium 162 is, for example, an inert gas. To this end, the element 15 is kept separated from the electrodes 11 and 12. The element 15 is here held against a wall of the chamber 16 opposite the wall 161. The electrically insulating medium 162 also separates the electrodes 11 and 12 to electrically insulate them inside the chamber 16. The internal surface of the chamber 16 is electrically insulating to guarantee the electrical insulation between the electrode 11, the electrode 12 and the conductive element 15. The switch 1 thus has a configuration of normally-open type between the electrodes 11 and 12, illustrated in FIG. 1. The switch 1 here has only the electrodes 11 and 12, insulated from the conductive element 15 in its open configuration.

The element 15 has a part directly above the first electrode 11, and a part directly above the second electrode 12. The switch 1 further comprises a pyrotechnic element 17. The pyrotechnic element 17 includes an explosive 171 attached to the conductive element 15, and a detonator 172 configured to initiate the explosion of the explosive 171. The explosion of the explosive 171 can be controlled by any appropriate means, for example by the application of an electrical signal to the detonator 172 via a control circuit 9 or via an overall heating up of the explosive 171.

Figure 2:
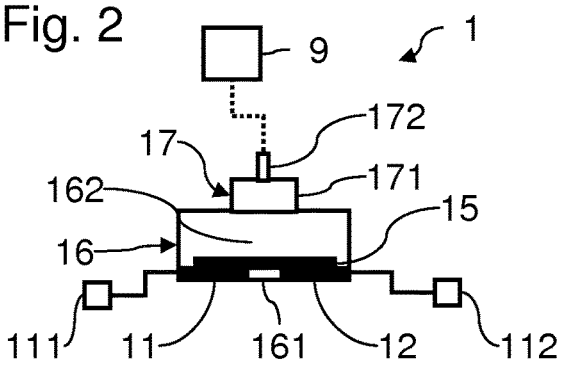

The explosive 171 is configured for the gases generated by its explosion to propel the element 15 through the chamber 16 toward the electrodes 11 and 12. Upon the explosion, the gases generated by the explosive 171 apply a pressure onto the element 15 to detach it from the chamber 16, to propel the element 15 into contact both with the electrode 11 and with the electrode 12, and to heat up this element 15. The element 15 is propelled with a sufficient energy to be welded to the electrode 11 on the one hand and to the electrode 12 on the other hand, according to the configuration illustrated in FIG. 2, solidly and durably. The heating up of the element 15 by the gases generated by the explosion further facilitates the welding between the element 15 and the electrodes 11 and 12. Conduction between the electrodes 11 and 12 is then assured via the element 15 and via the welds of this element 15 to the electrodes 11 and 12.

The switch 1 then has a reliable and durable closed configuration between the electrodes 11 and 12. The electrodes 11 and 12 and the element 15 advantageously comprise metallic materials. The metallic material of the element 15 enters into contact with the metallic materials of the electrodes 11 and 12 to form welds upon the explosion of the explosive 171.

Whereas a brazed joint consists in assembling two parts with an addition of intermediate material between these two parts, a weld secures the element 15 directly with each electrode 11 and 12 by fusion between their own materials, at the interface between these materials. The weld is here produced in a solid and durable manner, such that a brief fusion occurs at the interface between the element 15 and each electrode 11 and 12. This weld at the interface, of very brief duration, is reflected in an almost immediate return to the solid state of the surfaces in contact during the weld. Such a return to the solid state makes it possible to avoid a bounce effect.

Moreover, the element 15 is driven by the explosion in a direction at right angles to the contact surface of each electrode, the contact surface to which it has to be welded. Thus, the quality of the weld is maximized between the element 15 and each electrode, which also favors an absence of bounce. Advantageously, the contact surfaces of the electrodes 11 and 12 are substantially flat.

A direct pressure of the gases from the explosion onto the element 15 favors the heating up thereof (and therefore a weld at the interface upon a contact with the electrode 12), its deformation on contact with the electrode 12 and its propulsion at a supersonic speed. Such a propulsion also favors the welding between two different metals, for example when copper is used to form the element 15 and aluminum is used to form the electrode 12 (or vice-versa). Such a direct pressure of the gases also makes it possible to reduce the quantity of material to be moved and thus makes it possible to use a lesser quantity of explosive material.

A rapid explosion explosive can propel the element 15 at a speed of the order of 7500 m/s, a slow explosion explosive being able to propel the element 15 at a speed typically lying between 1500 and 2000 m/s. Such a type of welding is notably detailed in the U.S. Pat. No. 3,590,877 in order to repair heat exchange tubes. The patent EP0381880 also provides dimensioning rules for a quantity of explosive to be used as a function of the weight of the element to be welded by projection, in particular for a nitroguanidine-based explosive.

By using pyrotechnic elements marketed for airbag manufacture, tests have shown that 25 to 30% of the energy of the explosion was transferred as kinetic energy onto the element 15. By determining the energy necessary to produce a weld between the element 15 and the electrode 12, it will be possible to easily determine the quantity of explosive 171 to be included in the pyrotechnic element 17.

Figure 3:
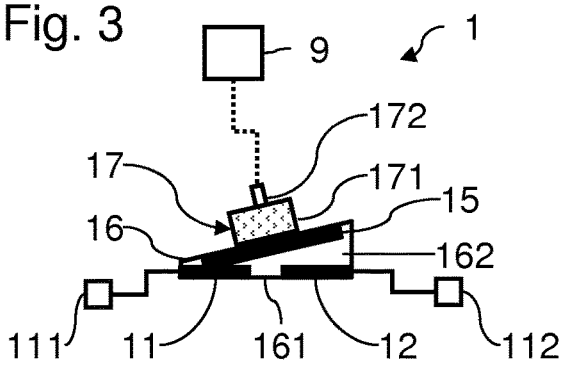
FIGS. 3 and 4 are schematic representations of a second exemplary switch according to the invention in two operating configurations.

FIG. 3 is a schematic cross-sectional view of a second exemplary switch 1 according to the invention. The switch 1 is also of the normally-open type between a first electrode 11 and a second electrode 12. The switch 1 of this second example reprises the features of the switch of the first example and differs in its open configuration only by the fact that the element 15 is electrically linked to the electrode 11 and is mechanically fixed to this electrode 11. To favor the electrical contact between the element 15 and the electrode 11 and the mechanical strength of their link, the electrode 11 and the element 15 are advantageously formed of a single piece. In FIG. 3, the switch 1 is illustrated in its configuration of normally-open connection between the electrodes 11 and 12.

Figure 4:
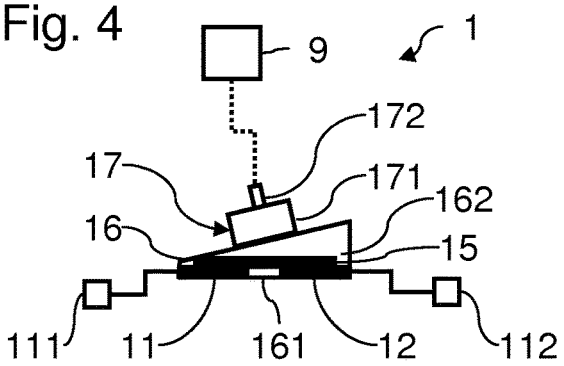

The explosive 171 is configured for the gases generated by its explosion to propel an end of the element 15 through the chamber 16 toward the electrode 12. This end is initially directly above the electrode 12. Upon the explosion, the gases generated by the explosive 171 apply a pressure onto this end of the element 15 to propel it into contact with the electrode 12 and to heat up this element 15. The element 15 is propelled with a sufficient energy to be welded to the electrode 12, according to the configuration illustrated in FIG. 4. The heating up of the element 15 by the gases generated by the explosion further facilitates the welding between the element 15 and the electrode 12. The conduction between the electrodes 11 and 12 is then assured via the element 15, its connection to the electrode 11 and via its welds with the electrode 12. The element 15 can also increase its link surface area with the electrode 11 and form welds with this electrode 11 upon the explosion of the explosive 171.

Figure 5:
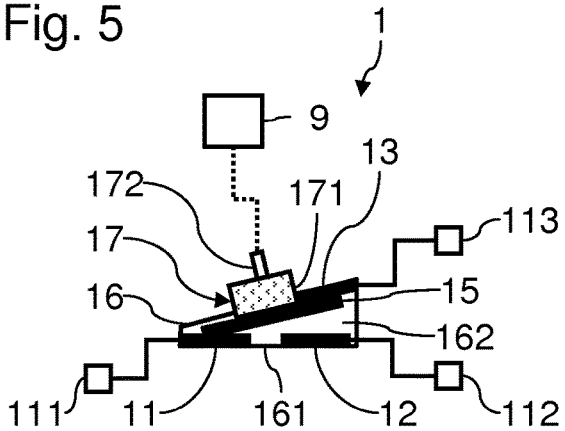
FIGS. 5 and 6 are schematic representations of a third exemplary switch according to the invention in two operating configurations.

FIG. 5 is a schematic cross-sectional view of a third exemplary switch 1 according to the invention. The switch 1 is, here, a reversing switch:

- the switch 1 has a normally-open switch function between a first electrode 11 and a second electrode 12;
- the switch 1 has a normally-closed switch function between the first electrode 11 and a third electrode 13.

The electrodes 11 and 12 are electrically conductive. The electrode 11 is for example electrically connected to a connector 111. The electrode 12 is for example electrically connected to a connector 112. The electrode 13 is for example electrically connected to a connector 113.

The electrodes 11 to 13 are here housed in a chamber 16. The electrodes 11 and 12 are fixed against an internal wall 161 of the chamber 16, in order to ensure that they are mechanically secured. The electrode 13 is fixed against an internal wall of the chamber 16, opposite the wall 161. The switch 1 further comprises an electrically conductive element 15. The element 15 is housed inside the chamber 16. The element 15 is separated from the electrode 12 via an electrically insulating medium 162 present in the chamber 16. To this end, the element 15 is kept separated from the electrode 12. The element 15 is here held against the wall of the chamber 16 opposite the wall 161. The electrically insulating medium 162 also separates the electrodes 11 and 12 to electrically insulate them inside the chamber 16. The internal surface of the chamber 16 is electrically insulating to guarantee the electrical insulation between the electrode 11 and the electrode 12, between the electrode 13 and the electrode 12, and between the conductive element 15 and the electrode 12. The switch 1 thus has a configuration of normally-open type between the electrodes 11 and 12, illustrated in FIG. 5.

The element 15 is electrically linked to the electrode 11 and is mechanically fixed to this electrode 11. To favor the electrical contact between the element 15 and the electrode 11 and the mechanical strength of their link, the electrode 11 and the element 15 are advantageously formed of a single piece. The element 15 is further electrically linked to the electrode 13 and is mechanically fixed to this electrode 13. The switch 1 thus has a configuration of normally-closed type between the electrodes 11 and 13, illustrated in FIG. 5.

The element 15 has an end directly above the electrode 12. The switch 1 further comprises a pyrotechnic element 17. The pyrotechnic element 17 includes an explosive 171 attached to the conductive element 15, and a detonator 172 configured to initiate the explosion of the explosive 171. The explosion of the explosive 171 can be controlled by any appropriate means, for example by the application of an electrical signal to the detonator 172 via a control circuit 9.

Figure 6:
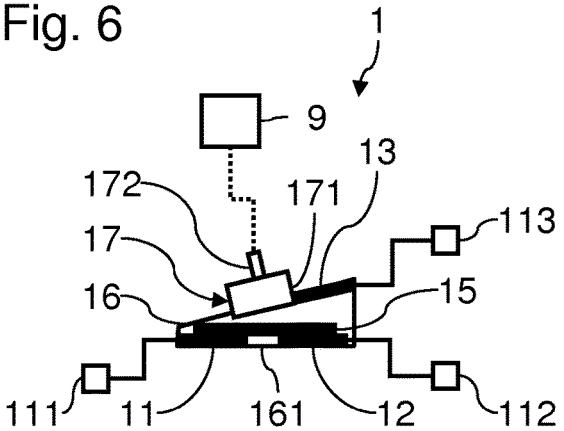

The explosive 171 is configured for the gases generated by its explosion to break the link between an end of the element 15 and the electrode 13. Consequently, the connection between the electrode 11 and the electrode 13 is open. The connection between the electrodes 12 and 13 also remains open. The gases generated by the explosion of the explosive 171 further propel this end of the element 15 through the chamber 16 toward the electrode 12. Upon the explosion, the gases generated by the explosive 171 apply a pressure onto this end of the element 15 to propel it into contact with the electrode 12 and to heat up this element 15. The element 15 is propelled with a sufficient energy to be welded to the electrode 12, according to the configuration illustrated in FIG. 6. The heating up of the element 15 by the gases generated by the explosion further facilitates the weld between the element 15 and the electrode 12. The conduction between the electrodes 11 and 12 is then assured via the element 15, its connection to the electrode 11 and via its welds with the electrode 12. The element 15 can also increase its link surface area with the electrode 11 and form welds with this electrode 11 upon the explosion of the explosive 171.

Figure 7:
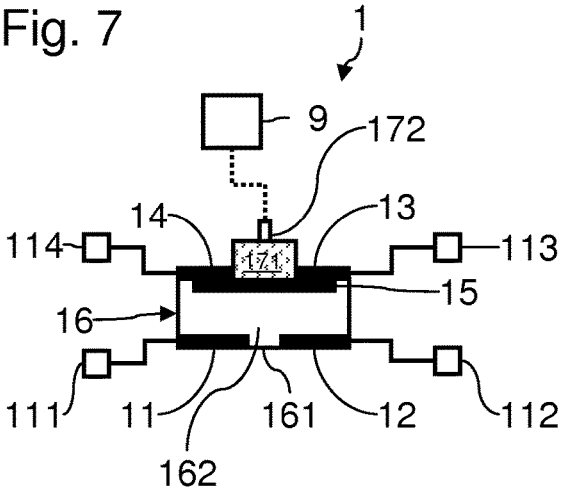
FIGS. 7 and 8 are schematic representations of a fourth exemplary switch according to the invention in two operating configurations.

FIG. 7 is a schematic cross-sectional view of a fourth exemplary switch 1 according to the invention. The switch 1 is of the normally-open type between a first electrode 11 and a second electrode 12 and of the normally-closed type between a third electrode 13 and a fourth electrode 14. The electrodes 11, 12, 13 and 14 are electrically conductive. The electrode 11 is for example electrically connected to a connector 111. The electrode 12 is for example electrically connected to a connector 112. The electrode 13 is for example electrically connected to a connector 113. The electrode 14 is for example electrically connected to a connector 114.

The electrodes 11 to 14 are housed in a chamber 16. The electrodes 11 and 12 are fixed against an internal wall 161 of the chamber 16, in order to ensure that they are mechanically held. The electrodes 13 and 14 are fixed against an internal wall of the chamber 16, in order to ensure that they are mechanically held, this wall being opposite the wall 161.

The switch 1 further comprises an electrically conductive element 15. The element 15 is housed inside the chamber 16. The element 15 is separated from the electrodes 11 and 12 via an electrically insulating medium 162 present in the chamber 16. To this end, the element 15 is kept separated from the electrodes 11 and 12. The element 15 is here fixed to the electrodes 13 and 14 and electrically connects the electrodes 13 and 14. The switch 1 thus has a configuration of normally-closed type between the electrodes 13 and 14, illustrated in FIG. 7.

The electrically insulating medium 162 also separates the electrodes 11 and 12 to electrically insulate them inside the chamber 16. The insulating medium 162 also separates the electrodes 11 and 12 from the electrodes 13 and 14. The internal surface of the chamber 16 is electrically insulating to guarantee the electrical insulation between the electrode 11 and the electrode 12 relative to one another, and to the conductive element 15, the electrode 13 and the electrode 14. The switch 1 thus has a configuration of normally-open type between the electrodes 11 and 12, illustrated in FIG. 7.

The element 15 has a part directly above the first electrode 11, and a part directly above the second electrode 12. The switch 1 further comprises a pyrotechnic element 17. The pyrotechnic element 17 includes an explosive 171 attached to the conductive element 15, and a detonator 172 configured to initiate the explosion of the explosive 171. The explosion of the explosive 171 can be controlled by any appropriate means, for example by the application of an electrical signal to the detonator 172 via a control circuit 9.

Figure 8:
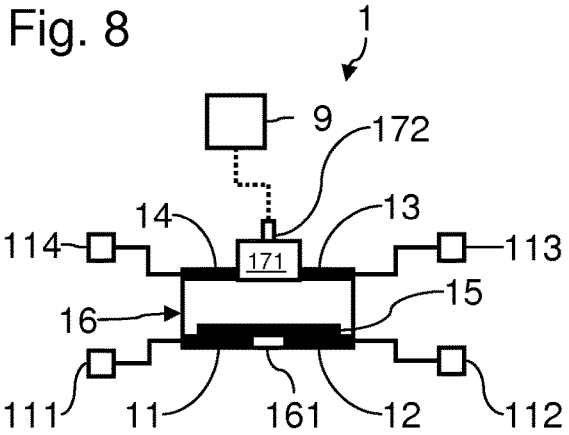

The explosive 171 is configured for the gases generated by its explosion to detach the element 15 from the electrodes 13 and 14, and propel the element 15 through the chamber 16 toward the electrodes 11 and 12. Upon the explosion, the gases generated by the explosive 171 apply a pressure onto the element 15 to detach it from the electrodes 13 and 14, to propel the element 15 into contact both with the electrode 11 and with the electrode 12, and to heat up this element 15. The element 15 is propelled with a sufficient energy to be welded to the electrode 11 on the one hand and to the electrode 12 on the other hand, according to the configuration illustrated in FIG. 8. The heating up of the element 15 by the gases generated by the explosion further facilitates the weld between the element 15 and the electrodes 11 and 12. The conduction between the electrodes 11 and 12 is then assured via the element 15 and via the welds of this element 15 to the electrodes 11 and 12.

The switch 1 then has a reliable and durable closed configuration between the electrodes 11 and 12. The switch 1 then has an open configuration between the electrodes 13 and 14 (then separated by the medium 162), between the electrodes 11 and 13, between the electrodes 11 and 14, between the electrodes 12 and 13 and between the electrodes 12 and 14.

Figure 9:
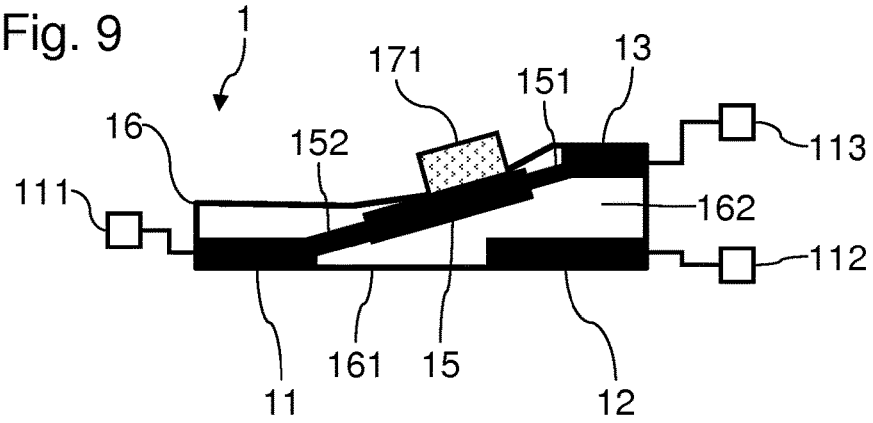
FIG. 9 illustrates a variant of the third exemplary switch before activation of its pyrotechnic element.

FIG. 9 is a schematic cross-sectional view of a variant of the third exemplary switch 1 before the explosion of the explosive 171. To facilitate the break between the element 15 and the electrode 13 upon the explosion:

- the element 15 and the electrode 13 are linked by an electrically conductive junction 151;
- the element 15, the electrode 13 and the junction 151 are formed of a single piece;
- the cross section of the junction 151 is smaller than the cross section of the electrode 13 and smaller than the cross section of the element 15. To guarantee the breaking of the electrical contact between the element 15 and the electrode 13 upon the explosion, the breaking force of the link 151 is less than the mechanical strength of the fixing between the electrode 13 and the chamber 16.

To facilitate the pivoting of the element 15 relative to the electrode 11 upon the explosion:

- the element 15 and the electrode 11 are linked by an electrically conductive junction 152;
- the element 15, the electrode 11 and the junction 152 are formed of a single piece;
- the cross section of the junction 152 is smaller than the cross section of the electrode 11 and smaller than the cross section of the element 15.

Figure 10:
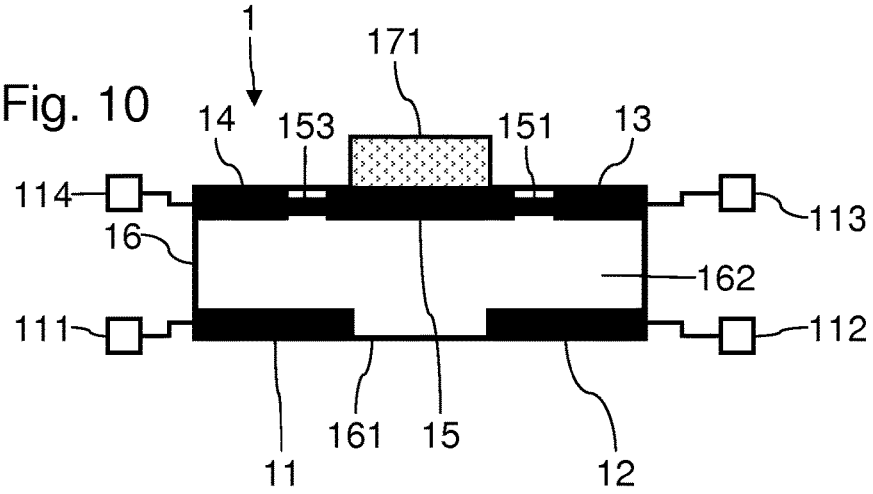
FIG. 10 illustrates a variant of the fourth exemplary switch before activation of its pyrotechnic element.

FIG. 10 is a schematic cross-sectional view of a variant of the fourth exemplary switch 1 before the explosion of the explosive 171.

To facilitate the break between the element 15 and the electrode 13 upon the explosion:

- the element 15 and the electrode 13 are linked by an electrically conductive junction 151;
- the element 15, the electrode 13 and the junction 151 are formed of a single piece;
- the cross section of the junction 151 is smaller than the cross section of the electrode 13 and smaller than the cross section of the element 15. To guarantee the breaking of the electrical contact between the element 15 and the electrode 13 upon the explosion, the breaking force of the link 151 is less than the mechanical strength of the fixing between the electrode 13 and the chamber 16.

To facilitate the break between the element 15 and the electrode 14 upon the explosion:

- the element 15 and the electrode 14 are linked by an electrically conductive junction 153;
- the element 15, the electrode 14 and the junction 153 are formed of a single piece;
- the cross section of the junction 153 is smaller than the cross section of the electrode 14 and smaller than the cross section of the element 15. To guarantee the breaking of the electrical contact between the element 15 and the electrode 14 upon the explosion, the breaking force of the link 153 is less than the mechanical strength of the fixing between the electrode 14 and the chamber 16.

Figure 11:
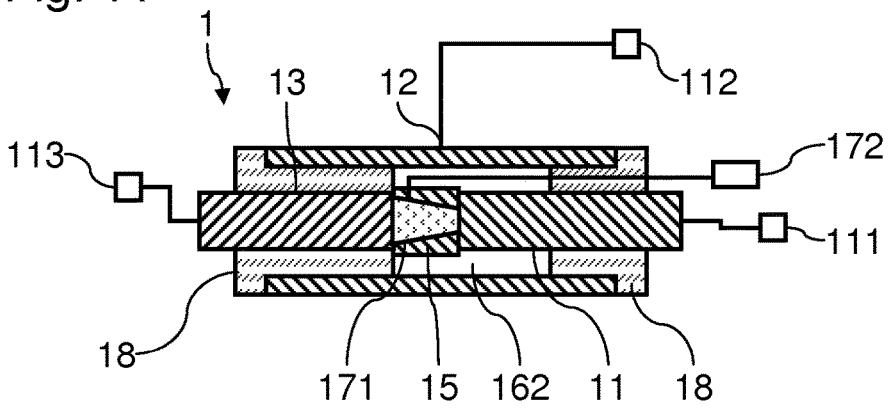
FIG. 11 illustrates another variant of the third exemplary switch before activation of its pyrotechnic element.

FIG. 11 is a schematic cross-sectional view of another variant of the third exemplary switch 1 according to the invention. The electrode 11 is formed by the end of a metal cable. The electrode 13 is also formed by the end of a metal cable. The electrode 13 is also formed by the end of a metal cable. The ends of these metal cables are aligned. The element 15 is fixed on the one hand to the electrode 11 and on the other hand to the electrode 13. The element 15 electrically links the electrode 11 and the electrode 13. A cavity is formed inside the element 15. The cavity contains the explosive 171. The section of the cavity is advantageously greater at the junction between the element 15 and the electrode 13, relative to the section of the cavity at the junction between the element 15 and the electrode 11. Thus, upon the explosion, a continuity of material is retained between the element 15 and the electrode 11, whereas a breaking of material is obtained between the element 15 and the electrode 13.

The electrode 12 includes an electrically conductive sleeve surrounding the element 15. The sleeve of the electrode 12 is separated from the element 15 by an annular space. The annular space also forms a separation between the electrodes 11 and 13. The electrodes 11 and 13 are advantageously fixed inside insulating blocks 18. The insulating blocks 18 electrically insulate the electrodes 11 and 13 relative to the electrode 12.

Upon the explosion of the explosive 171, a break is produced between the element 15 and the electrode 13 to open the connection between the electrode 11 and the electrode 13. The element 15 is deformed in the annular space until it comes into contact with the sleeve of the electrode 12. The electrical connection between the electrode 11 and the electrode 12 is thus closed. The electrode 12 and the electrode 13 then remain electrically insulated via a block 18 and an insulating medium 162 present in the annular space.

For a nominal current of 200 A, metal copper cables will be able to have a section of 70 mm2. The element 15 will be able to be dimensioned to guarantee an equivalent welding surface area with the sleeve of the electrode 12.

Figure 12:
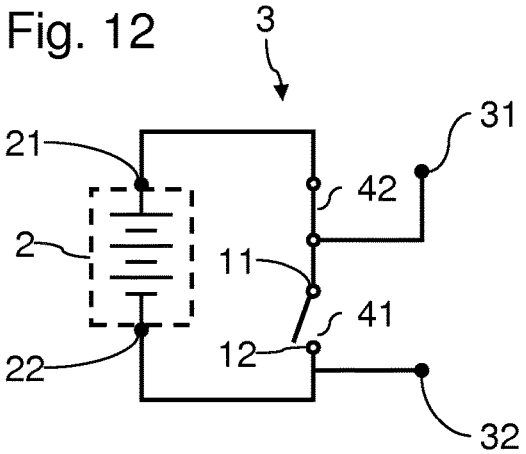
FIGS. 12 and 13 are electrical circuit diagrams of an exemplary DC power supply source including a switch according to the second example, in two operating configurations.
Figure 13:
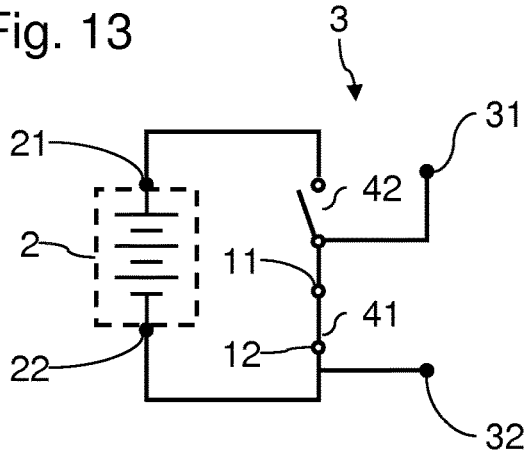

FIGS. 12 and 13 are electrical circuit diagrams of an application of the second exemplary switch according to the invention, in different modes of operation. A DC voltage power supply system 3 has first and second output terminals 31 and 32. A switch 41 according to the first example has its electrode 11 connected to the first terminal 31 and its electrode 12 connected to the second terminal 32. The power supply 3 further includes a DC voltage power source 2, in this case a battery of electrochemical accumulators. The source 2 has first and second poles 21 and 22. The first pole 21 is connected to the first electrode 11 and to the first terminal 31 via a switch 42. Between the terminals 31 and 32, the power supply system 3 comprises two parallel branches:

- a first branch in which the switch 42 and the source 2 are connected in series;
- a second branch in which the conduction is conditioned by the switch 41.

The switch 41 is of the normally-open type. The switch 42 can be selectively opened or closed via a control circuit that is not illustrated.

In normal operation, when the voltage from the source 2 is to be applied between the terminals 31 and 32, the switch 41 is kept open and the switch 42 is kept closed, as illustrated in FIG. 12.

In case of a malfunction, for example if an excessive temperature is measured at the source 2 (for example a temperature close to the thermal runaway temperature of an electrochemical accumulator) or at the connections, the explosion of the explosive of the pyrotechnic element of the switch 41 is controlled. Thus, the switch 41 is closed and a short-circuit is thus formed between the terminals 31 and 32, which makes it possible to maintain a conduction between these terminals. Moreover, the switch 42 is open and the link between the terminal 31 and the pole 21 is therefore broken, such that the source 2 can no longer output current.

Figure 14:
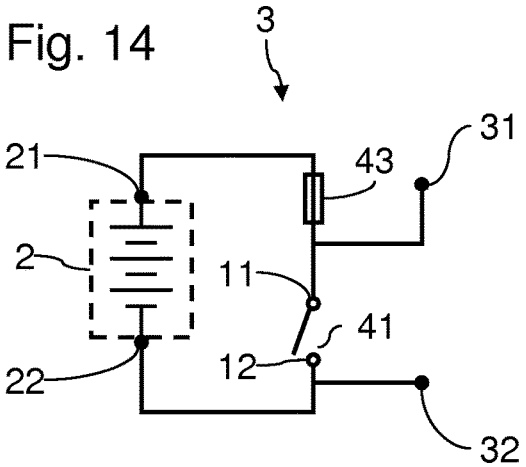
FIG. 14 is an electrical circuit diagram of an exemplary DC power supply including a switch according to the second example.

FIG. 14 is an electrical circuit diagram of an application of the second exemplary switch according to the invention, in a normal operating mode. Compared to the power supply system of FIG. 12, the switch 42 is replaced by a fuse 43. Thus, between the terminals 31 and 32, the power supply system 3 comprises two parallel branches:

- a first branch in which the fuse 43 and the source 2 are connected in series;
- a second branch in which the conduction is conditioned by the switch 41.

Since the switch 41 is of the normally-open type, in normal operation, the voltage between the poles 21 and 22 of the source 2 is applied between the terminals 31 and 32.

Upon a malfunction causing an excessive current to be output by the source 2, the closure of the switch 41 is controlled by an explosion of the explosive 171 and the fuse 43 melts to open the connection between the pole 21 and the terminal 31.

Figure 15:
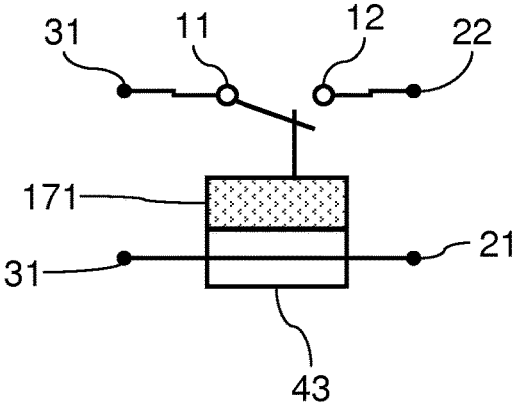
FIG. 15 is a schematic representation of a variant of a switch according to the second example.

FIG. 15 is a schematic representation of a variant switch 41 according to the second example. In the application to a power supply system as illustrated in FIG. 14, it is desirable for the heating up of the fuse 43 associated with a possible short-circuit current from the source 2 to be used to trigger the explosion of the explosive 171. Thus, a heating up of the fuse 43 automatically makes it possible to produce the closure of the switch 41. To this end, a thermal bridge is formed between the fuse 43 and the explosive 171 such that the fuse 43 forms a detonator of the explosive 171 when it heats up. A thermal bridge between the fuse 43 and the explosive 171 can for example be produced by placing the fuse 43 in contact with a thermally conductive casing containing the explosive 171. Based on the amplitude and the duration of the short-circuit current, the fuse 43 ends up opening to insulate the pole 21 from the terminal 31.

To obtain such automatic triggering, the fuse 43 is advantageously dimensioned as follows. If Iccmax is used to designate the maximum short-circuit current output by the DC voltage source 2, the fuse 43 is dimensioned to remain closed when it is passed through by this current Iccmax for a time sufficient for its heating up to initiate the explosion of the explosive 171.

Figure 16:
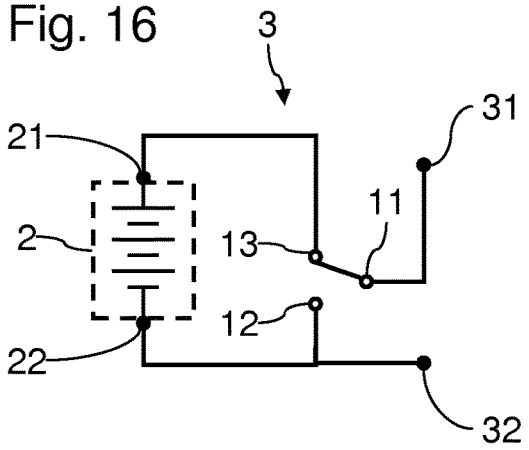
FIG. 16 is an electrical circuit diagram of an exemplary DC power supply including a switch according to the third example.

FIG. 16 is an electrical circuit diagram of an application of the third exemplary switch according to the invention. The pole 21 of the DC voltage source 2 is connected to the third electrode 13 of the switch 1. The terminal 31 of the system 3 is connected to the first electrode 11 of the switch 1. The second electrode 12 is connected to the pole 22 and to the terminal 32. As detailed previously, the conduction between the electrode 11 and the electrode 13 is of the normally-closed type and the connection between the electrode 11 and the electrode 12 is of the normally-open type. Thus, in normal operation, the potential difference between the poles 21 and 22 is applied between the terminals 31 and 32. Upon a malfunction, the explosive 171 opens the connection between the electrode 11 and the electrode 13 and closes the connection between the electrode 11 and the electrode 12. Thus, the pole 21 is disconnected from the terminal 31 and a short-circuit is formed between the terminals 31 and 32. This variant makes it possible to avoid the conduction losses of a semiconductor switch between the electrodes 11 and 13 in normal operation.

Figure 17:
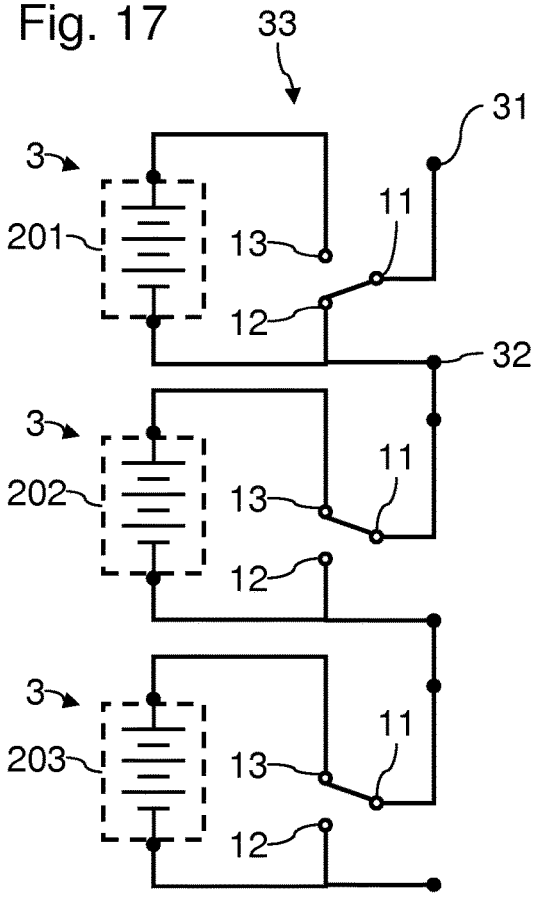
FIG. 17 is an electrical circuit diagram of an exemplary DC power supply including a number of modules connected in series, illustrating a continuity of service in the presence of a malfunction of one of the modules.

A power supply system 31 is illustrated in FIG. 17. This system 31 comprises a number of systems 3 detailed with reference to FIG. 16 connected in series. These systems 3 respectively comprise DC voltage sources 201, 202 and 203. Because of a malfunction at the source 201, the connection between the electrode 11 and the electrode 13 of the switch 1 is opened and the connection between the electrode 11 and the electrode 12 of this switch 1 is closed. The terminals 31 and 32 are therefore short-circuited. In the absence of malfunction at the sources 202 and 203, their system 3 remains in normal operating mode. Because of the quality of the conduction through the switch 1, a current of high intensity can pass through this switch. Consequently, the sources 202 and 203 can continue to output current. The system 31 thus allows for a continuity of service, which is particularly useful when the system 31 powers a vehicle motor drive.

An identical continuity of service is obtained by connecting the systems 3 as detailed with reference to FIGS. 12 and 14 in series.

The invention claimed is:

1. A switch, comprising:

a first electrode;

a second electrode;

an electrically conductive element;

an electrically insulating medium configured to separate the first electrode and the second electrode and to separate the electrically conductive element from the second electrode; and a pyrotechnic element including an explosive, wherein an explosion of the explosive induces the electrically conductive element to heat up before contact with a contact surface of the second electrode, and the explosion of the explosive induces the electrically conductive element to be driven into contact with the contact surface of the second electrode to weld the electrically conductive element with the second electrode, by welding first materials of the electrically conductive element to second materials of the second electrode by fusion of the first materials and the second materials at an interface between the first materials and the second materials, and forming a solid electrically conductive link between the first electrode and the second electrode.

2. The switch as claimed in claim 1, wherein the second electrode and the electrically conductive element comprise respective metallic materials coming into contact and being welded together upon the explosion of the explosive.

3. The switch as claimed in claim 1, further comprising:

a chamber, into which pressurized gas produced by the explosion of the explosive is discharged, wherein the electrically conductive element is arranged to be exposed to the pressurized gas produced by the explosion of the explosive.

4. The switch as claimed in claim 3, wherein the second electrode is fixed against an internal wall of the chamber.

5. The switch as claimed in claim 1, wherein the electrically insulating medium is further configured to separate the electrically conductive element from the first electrode, and the explosion of the explosive induces the electrically conductive element to be driven into contact with the first electrode and the electrically conductive element to be welded with the first electrode to form the electrically conductive link between the first electrode and the second electrode.

6. The switch as claimed in claim 1, wherein the electrically conductive element and the first electrode are formed of a single piece.

7. The switch as claimed in claim 6, further comprising:

a third electrode in electrical contact with the electrically conductive element, wherein the third electrode is separated from the second electrode by the electrically insulating medium, and the explosion of the explosive induces the electrically conductive element to be driven to separate the electrically conductive element from the third electrode by the electrically insulating medium.

8. The switch as claimed in claim 7, wherein the third electrode, the electrically conductive element, and an electrically conductive junction between the third electrode and the electrically conductive element are formed of a single piece, and the electrically conductive junction has a cross section smaller than a cross section of the electrically conductive element and smaller than a cross section of the third electrode.

9. The switch as claimed in claim 7, wherein the first electrode is formed by an end of a first metal cable, the third electrode is formed by an end of a second metal cable, the electrically conductive element connects the first electrode and the third electrode and includes a cavity in which the explosive is housed, and the second electrode includes an electrically conductive sleeve surrounding the electrically conductive element and separated from the electrically conductive element by an annular space.

10. The switch as claimed in claim 1, wherein the explosion of the explosive drives the electrically conductive element in a direction perpendicular to the contact surface of the second electrode.

11. The switch as claimed in claim 1, wherein the driving of the electrically conductive element is in a direction perpendicular to a contact surface of the second electrode upon the contact between the electrically conductive element and the contact surface of the second electrode.

12. The switch as claimed in claim 1, wherein the solid electrically conductive link remains after the explosion.

13. The switch as claimed in claim 1, wherein the electrically conductive element is heated up to have sufficient energy to be welded with the second electrode before contact with the contact surface of the second electrode.

14. The switch as claimed in claim 1, wherein the heat from the explosion directly heats the electrically conductive element, and the heated electrically conductive element directly heats the second electrode to facilitate the welding of the first materials and the second materials.

15. The switch as claimed in claim 1, wherein the electrically insulating medium is an inert gas.

* * * * *